US005778500A

United States Patent [19]

Illingworth

[11] Patent Number: 5,778,500

[45] Date of Patent: Jul. 14, 1998

[54] KNOT SECURING DEVICE

[76] Inventor: Moise Illingworth, 37826 Boxthorn St., Palmdale, Calif. 93550

[21] Appl. No.: 821,221

[22] Filed: Mar. 20, 1997

[51] Int. Cl.[6] ..... A43B 11/00

[52] U.S. Cl. ..... 24/712.3; 24/712; 24/712.2; 24/713.6

[58] Field of Search ..... 24/712.3, 712, 24/712.1, 712.2, 713.6, 306; 36/50.1

[56] References Cited

U.S. PATENT DOCUMENTS

| | | | |
|---|---|---|---|
| 2,871,537 | 1/1959 | Hickerson . | |
| 3,473,198 | 10/1969 | Meier | 24/712.3 |
| 4,282,657 | 8/1981 | Antonious | 24/306 |
| 4,290,172 | 9/1981 | Burton . | |
| 4,291,439 | 9/1981 | Ritti . | |
| 4,414,761 | 11/1983 | Mahood | 24/712 |
| 4,428,101 | 1/1984 | Harkavy . | |
| 4,553,293 | 11/1985 | Blum | 24/712.2 |
| 4,571,854 | 2/1986 | Edens . | |
| 4,780,936 | 11/1988 | Brecher . | |
| 4,879,787 | 11/1989 | Walls . | |
| 4,949,437 | 8/1990 | Anderson . | |
| 4,999,888 | 3/1991 | Miller . | |
| 5,042,119 | 8/1991 | Williams | 24/712.3 |
| 5,097,573 | 3/1992 | Gimeno . | |
| 5,119,539 | 6/1992 | Curry . | |
| 5,129,130 | 7/1992 | Lecouturier . | |
| 5,170,573 | 12/1992 | Clinch | 24/712.2 |
| 5,353,483 | 10/1994 | Louviere . | |
| 5,459,947 | 10/1995 | Lasher | 24/306 |

*Primary Examiner*—Victor N. Sakran
*Attorney, Agent, or Firm*—Kelly Bauersfeld Lowry & Kelley, LLP

[57] ABSTRACT

A knot securing device of particular benefit in securing shoelace knots made from a flexible material with a region having hook elements, a region having loop elements and a pair of apertures in the flexible material for allowing the open ends of a shoelace to pass through from one surface of the material to the opposite surface of the material, wherein the shoelace is then tied in a knot and the regions with the hook and loop elements are brought into contact to form a secure, but releasable, lock around the knot.

4 Claims, 1 Drawing Sheet

KNOT SECURING DEVICE

BACKGROUND OF THE INVENTION

This invention relates generally to fastening devices for securing laced-up articles, and more particularly to a device used to secure knots in laced-up articles of clothing.

Most individuals have experienced the problem of having tied-up laces in various articles of clothing becoming untied. This problem is most often encountered with items of footwear where the wearer typically makes a bow knot to tie the laces. In addition to creating an annoyance and inconvenience factor in having to stop and re-tie the shoelaces, untied shoelaces drag on the floor and the wearer or another person may unknowingly step on the untied shoelace or the shoelaces may get caught against another object, causing the wearer to trip and possibly injure himself or others. The potential for such accidents and resulting injuries is particularly great among athletes, sports enthusiasts, children, elderly and construction workers.

Another problem with untied shoelaces is that as a result of being dragged out on the floor they get dirty and wear out faster, which forces the wearer to purchase new shoelaces. However, with new shoelaces on worn out and older looking shoes, the wearer may end up with an annoying visual incompatibility problem between the shoelaces and the shoes. In such cases, some consumers, especially teenagers, may prefer to purchase new shoes in place of the old ones, thereby resulting in an additional expenditure.

Thus, there is a need for a device to secure and protect knots in laced-up articles of clothing such as shoes that is inexpensive, of simple construction, easy to manufacture of readily available materials, flexible so as to be comfortable, easy to use and adaptable to fit all laced-up articles of clothing with various sizes and shapes. The present invention fulfills these needs and provides other related advantages.

SUMMARY OF THE INVENTION

The present invention resides in a knot securing device which advantageously permits laced-up articles of clothing, particularly footwear to remain tied to allow the wearer to avoid the annoyance and the risk of injury and hazardous situations arising from untied laces. The knot securing device comprises, generally, a flexible piece of material with an opening therethrough to allow the laces to go through to be tied into a knot, and regions carrying hook and loop type elements which can come into contact together to form a releasable lock around the knot. While the present invention will be described will reference to shoes and shoelaces, it is to be understood that the invention is equally useable in connection with other laced-up articles of clothing as well.

In a preferred form of the invention, the flexible piece of material is made of a substantially flat patch or strip of material (e.g., leather) that can be easily folded along a folding line or region. The patch of flexible material includes regions of hook and loop elements, more commonly known by the name VELCRO, with both regions positioned on the upper surface of the flexible material. The hook elements are disposed on the flexible material on one side of the folding line and the loop elements are disposed on the flexible material on the other side of the folding line.

The flexible material is also provided with a pair of apertures located on one side of the folding line for allowing the open ends of a shoelace to be inserted therethrough and tied in a knot above the upper surface of the flexible material. In this manner, the device of the invention is fixed in position and is attached to the shoelace. With the ends of the shoelace tied in a desirable knot (such as a bow-knot), the flexible material is folded about the folding line, and the hook and loop elements connect together to form a secure, but releasable, lock around the shoelace knot so as to help prevent the knot from becoming untied.

Accordingly, use of the knot securing device of the present invention helps to maintain shoelaces tied to prevent the occurrence of hazardous/annoying situations associated with untied shoelaces, and also helps to prevent the premature wearing out of shoelaces.

The knot securing device of the invention can be economically and easily manufactured in desirable sizes, shapes, colors and designs. The invention is also easy to use by individuals of all ages and its flexible design makes it adaptable and comfortable for use with various styles of footwear.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
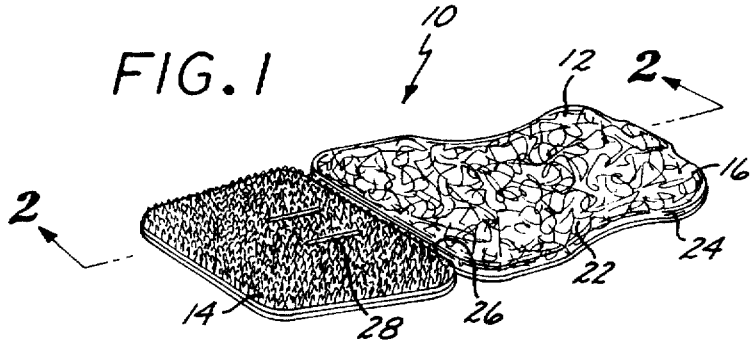
FIG. 1 is a perspective view of a knot securing device embodying invention.

As shown in the exemplary drawings, the knot securing device of the present invention is illustrated generally at 10. The knot securing device 10 is comprised generally of a patch or strip of material 12, a region carrying hook elements 14, a region carrying loop elements 16 and a pair of apertures 28 in the material patch.

Figure 3:
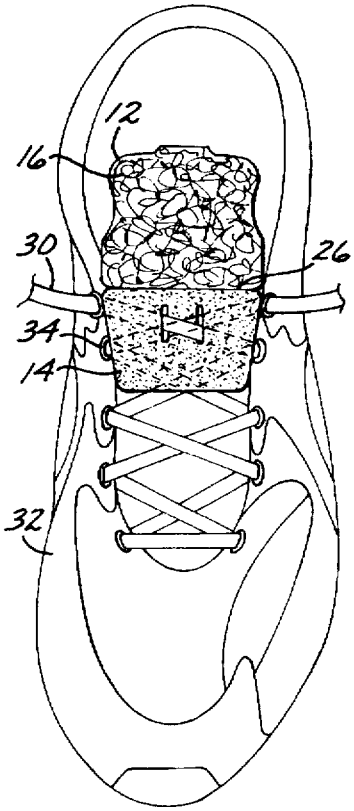
FIG. 3 is a front top perspective view of the knot securing device illustrated in FIG. 1, showing the device being used in conjunction with a shoe with the open ends of a shoelace inserted through a pair of apertures in the device of the invention.

The material patch 12 is made of a flexible material such as leather, imitation leather or other suitable material that is lightweight and capable of being folded and unfolded repeatedly without significant deterioration. As shown in FIG. 3, the material patch 12 preferably is sized and shaped substantially similar to the upper portion of a typical shoe tongue 20. However, it is understood that the particular size and shape of the material patch 12 is not critical to its operation.

The material patch 12 has an upper surface 22 and a lower surface 24, and includes regions of hook and loop elements, more commonly known as VELCRO, on its upper surface 22. The region of hook elements 14 and the region of loop elements 16 are preferably disposed on the upper surface 22 on opposite sides of a folding line 26 along which the material patch may fold and bring the hook and loop regions into mating contact. The hook and loop regions are preferably glued or stitched to the material patch. However, the specific means by which the hook and loop regions are disposed on the material patch 12 and their size and locations are not critical, provided that the hook and loop regions can be repeatedly connected and disconnected.

Figure 2:
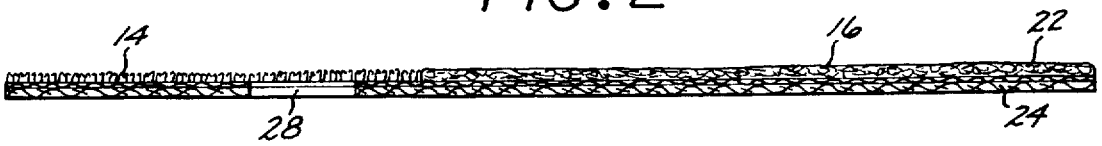
FIG. 2 is an enlarged elevational cross-sectional view of the knot securing device illustrated in FIG. 1, taken generally along the line 2–2.

The material patch 12 is also provided with preferably a pair of apertures 28 positioned on one side of folding line 26 such that the openings in the apertures extend through the material patch. If the hook or loop elements are disposed on the material patch in the area of the apertures, as is shown in FIGS. 1–3, the apertures also extend through the hook or loop elements in that area. As illustrated in FIG. 1 by way of example, the pair of apertures 28 are provided in the form of two side by side slotted openings in the center of the portion of the material patch 12 carrying the hook elements 14. While not illustrated in the drawings, it is to be understood that a single aperture or more than two apertures in the material patch may alternatively be used to allow the ends of a shoelace to be inserted through to secure the shoelace to the material patch.

Figure 4:
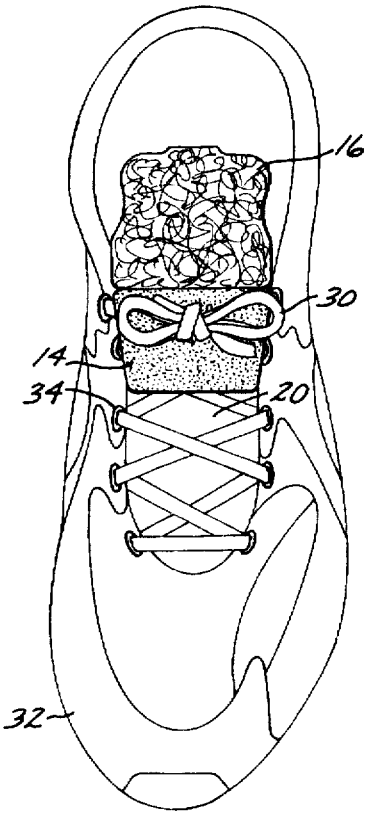
FIG. 4 is a front top perspective view similar to FIG. 3, with the shoelace tied in a bow-knot.
Figure 5:
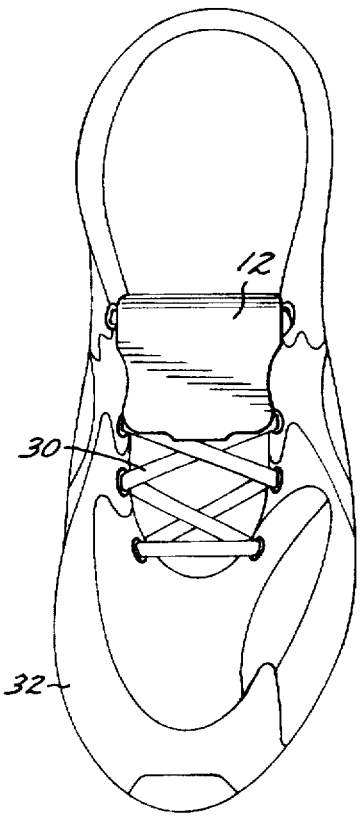
FIG. 5 is a front top perspective view similar to FIGS. 3 and 4, with the knot securing device in a closed position over the bow-knot of the shoelace.

In operation, with reference to FIGS. 3, 4 and 5, the material patch 12 is placed unfolded over shoelaces 30 of the shoe 32 near the upper portion of the shoe tongue 20. The two ends of the shoelace 30 that have been inserted through the next to last eyelets 34 of the shoe 32 are individually inserted in a crossing manner from the lower surface 24 of the material patch to pass through one aperture 28 to its upper surface 22 and back through the other aperture 28 to extend below the lower surface 24. Once the ends of the shoelace have passed through the apertures and are above the upper surface 22 of the material patch, the shoelace ends are extended through the last eyelets 34 of the shoe 32 so that they can be tied in a desirable manner, typically in a bow-knot. The material patch 12 is then folded about the folding line such that the region with the loop elements 16 comes over the knot and contacts the region with the hook elements 14 to form a secure, but releasable, lock over the knot.

The knot securing device 10 of the present invention is useful for individuals who wear laced-up footwear, and is particularly useful for athletes, children, elderly and workers for whom the risk of untied shoelaces causing injury or a hazardous condition is particularly high. While the device of the present invention is directed mostly to securing shoelace knots, it should also be understood that the invention may be equally useful in securing knots in other laced-up articles of clothing.

Although a particular form of the invention has been illustrated and described, it will be apparent that various modifications can be made without departing from the spirit and scope of the invention.

I claim:

1. A device for securing a bow-type knot, comprising:

a flexible patch of material having first and second surfaces and adaptable to be folded about a folding region;

a region of hook elements entirely overlying said second surface of said patch of material on one side of said folding region;

a region of loop elements entirely overlying said second surface of said patch material on a side of said folding region opposite said region of hook elements; and a pair of apertures extending through either said region of hook elements or said region of loop elements to allow two ends of a lace member forming the bow-type knot to pass therethrough from said first surface to said second surface;

wherein said flexible patch of material is folded about said folding region to bring said region of hook elements into contact with said region of loop elements to form a releasable lock that envelops the bow-type knot.

2. The device of claim 1, wherein said pair of apertures in said patch of material are slotted apertures positioned side by side on said patch.

3. The device of claim 2, wherein said pair of apertures in said patch of material are located in and extend through said region of loop elements.

4. The device of claim 2, wherein said pair of apertures in said patch of material are located in and extend through said region of hook elements.

* * * * *